US008127507B1

(12) United States Patent
Bilge

(10) Patent No.: US 8,127,507 B1
(45) Date of Patent: Mar. 6, 2012

(54) SYSTEM FOR MOUNTING WALL PANELS TO A WALL STRUCTURE

(76) Inventor: Henry H. Bilge, Fort Lee, NJ (US)

( * ) Notice: Subject to any disclaimer, the term of this patent is extended or adjusted under 35 U.S.C. 154(b) by 230 days.

(21) Appl. No.: 12/499,244

(22) Filed: Jul. 8, 2009

Related U.S. Application Data

(63) Continuation-in-part of application No. 11/691,579, filed on Mar. 27, 2007, now Pat. No. 7,621,084, and a continuation-in-part of application No. 11/615,979, filed on Dec. 24, 2006, now Pat. No. 7,472,521.

(51) Int. Cl.
*E04F 13/07* (2006.01)
*E04B 2/18* (2006.01)

(52) U.S. Cl. ..... 52/235; 52/506.05

(58) Field of Classification Search ..... 52/235, 52/506.05, 509–512, 656.9, 463, 468, 489.1, 52/483.1

See application file for complete search history.

(56) References Cited

U.S. PATENT DOCUMENTS 2,116,530 A 5/1938 McCabe
(Continued)

OTHER PUBLICATIONS

Reynobond Aluminum Composite Material Metal Wall Panels Brochure. 2008. Alcoa Architectural Products. 4 pages.*

(Continued)

*Primary Examiner* — Robert Canfield
*Assistant Examiner* — Christine T Cajilig
(74) *Attorney, Agent, or Firm* — Richard M. Goldberg

(57) ABSTRACT

A system for mounting wall panels to an existing wall structure, includes wall panels, each having a main panel section and hook walls at edges thereof which define a U-shaped configuration therewith; fastening extrusions, each including a securing section for securing the fastening extrusion to the existing wall structure, and a female connecting section including a recess and connected with the securing section; a frame extrusion connected to each hook wall, each including a securing section connecting the frame extrusion to a hook wall, a male connecting wall engaging within a recess of one female connecting section, and a spacer wall connecting the male connecting wall to the securing section so as to define a gap between the female connecting section and the hook wall when the male connecting wall is engaged within the recess; and a cover panel inserted in the gap.

14 Claims, 15 Drawing Sheets

U.S. PATENT DOCUMENTS

| | | | | | |
|---|---|---|---|---|---|
| 2,182,523 | A | | 12/1939 | Markowski | |
| 2,226,679 | A | | 12/1940 | Walters | |
| 2,395,726 | A | | 2/1946 | Del Tufo | |
| 3,831,506 | A | * | 8/1974 | Landheer | 454/303 |
| 4,095,385 | A | | 6/1978 | Brugman | |
| 4,189,885 | A | | 2/1980 | Fritz | |
| 4,344,267 | A | | 8/1982 | Sukolics | |
| 4,685,263 | A | * | 8/1987 | Ting | 52/235 |
| 4,829,740 | A | | 5/1989 | Hutchison | |
| 4,833,839 | A | | 5/1989 | Kurose | |
| 5,155,958 | A | | 10/1992 | Huff | |
| 5,212,914 | A | | 5/1993 | Martin et al. | |
| 5,226,274 | A | * | 7/1993 | Sommerstein | 52/512 |
| 5,544,461 | A | | 8/1996 | Sommerstein | |
| 5,546,713 | A | | 8/1996 | Voegele, Jr. et al. | |
| 5,809,729 | A | | 9/1998 | Mitchell | |
| 6,170,213 | B1 | | 1/2001 | Zarrelli et al. | |
| 6,170,214 | B1 | | 1/2001 | Treister et al. | |
| 6,298,627 | B1 | | 10/2001 | Richardson | |
| 6,484,465 | B2 | | 11/2002 | Higgins | |
| 6,694,694 | B2 | | 2/2004 | Zeeff | |
| 6,748,709 | B1 | | 6/2004 | Sherman et al. | |
| 6,843,032 | B2 | | 1/2005 | Hikai | |
| 7,210,273 | B2 | | 5/2007 | Zahner, III | |
| 7,562,504 | B2 | * | 7/2009 | Herbst et al. | 52/461 |
| 2002/0124514 | A1 | * | 9/2002 | Higgins | 52/506.06 |
| 2006/0179744 | A1 | * | 8/2006 | Lynch et al. | 52/235 |
| 2007/0022682 | A1 | * | 2/2007 | Morgenegg et al. | 52/235 |
| 2007/0119105 | A1 | * | 5/2007 | MacDonald et al. | 52/235 |
| 2008/0134594 | A1 | * | 6/2008 | Ness | 52/200 |
| 2009/0145071 | A1 | * | 6/2009 | Radford | 52/506.08 |
| 2009/0241444 | A1 | * | 10/2009 | Griffiths | 52/235 |

OTHER PUBLICATIONS

Bamco Inc. G500 wall system.

Creative Metal Contractors Inc., Toms River, New Jersey.

* cited by examiner 10
14
48
18
40c
40a
40b
70
26
12
20
16
24
22

SYSTEM FOR MOUNTING WALL PANELS TO A WALL STRUCTURE

REFERENCE TO RELATED APPLICATION

The present application is a continuation-in-part of pending U.S. patent application Ser. No. 11/691,579 filed Mar. 27, 2007 entitled SYSTEM FOR MOUNTING WALL PANELS TO A WALL STRUCTURE to the same inventor herein, which in turn, is a continuation-in-part of U.S. Pat. No. 7,472,521, issued Jan. 6, 2009 entitled SYSTEM FOR MOUNTING WALL PANELS TO A WALL STRUCTURE to the same inventor herein, the entire disclosures of both being incorporated herein by reference.

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation "G500 WALL SYSTEM." With this system, the wall panels are provided with right angle or bends at their edges. Each planar panel and the right angle bend together form an L-shape. Each bend is secured by screws to a fastening extrusion having the same linear dimension as the wall panel, and the fastening extrusion has a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

U.S. patent application Ser. No. 11/691,579 and U.S. Pat. No. 7,472,521, by the same inventor herein disclose systems for mounting wall panels to an existing wall structure, which includes a plurality of wall panels. There are also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

The main panel section has a rectangular configuration with four hook walls, and there are four fastening extrusions, with the recess of the retaining wall of each fastening extrusion receiving one hook wall of the wall panel. Each U-shaped cross-sectional profile defines a recess therein, and each fastening extrusion includes at least one stabilizing wall extending from a free end of a respective retaining wall, with the stabilizing wall being received in one recess of a respective U-shaped cross-sectional profile. Each stabilizing wall has an L-shaped cross-sectional profile. Also, the securing section and the retaining wall structure together define a U-shaped cross-sectional profile.

A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel. In a later embodiment, there is only a single fastening extrusion.

There is also at least one channel secured to the securing sections of adjacent fastening extrusions and positioned between adjacent wall panels corresponding thereto. An elongated plug is inserted into each channel for closing off the gap between adjacent wall panels.

This arrangement, however, requires the insertion of screws into the fastening extrusions and the channel while supporting the wall panels, which can be burdensome. It also requires the separate channels and plugs in order to close off the gap between adjacent wall panels to provide an aesthetic appearance between the wall panels. If the gap between adjacent panels is varied, this would also require a plurality of different size plugs, which can further add to the cost of the structure.

A further system has been sold for more than one year by Creative Metal Contractors Inc. of Toms River, N.J., which uses a single fastening extrusion having tongues extending from opposite sides thereof. The single fastening extrusion is secured to the existing wall by screws at a central portion thereof between the tongues. Each wall panel has a main panel section and hook walls at edges of the main panel section, with the main panel section and each hook wall having a U-shaped cross-sectional profile. Fasteners or frame extrusions are secured to the hook walls, with each fastener including walls defining a recess which receives a corresponding tongue of the single fastening extrusion, such that the tongues are spaced away from the hook walls. A compressed joint plug is positioned in overlying relation to the screws and between adjacent hook walls to provide an aesthetic appearance.

However, with this latter arrangement, plugs are also required, with the same consequent disadvantages. It may also be difficult to align the recesses over the tongues of the single fastening extrusion. In addition, the single fastening extrusions are secured to the existing wall by screws only through the center of the fastening extrusions, which can result in failure of such securement. Still further, if the gap between adjacent panels is varied, this would also require a plurality of different size plugs, which can further add to the cost of the structure.

In addition, in the latter arrangement, the gap between adjacent wall panels is sealed with a silicone sealant and a compressed joint plug. As a result, the air pressure behind the wall panels varies relative to the ambient air pressure in front of the panels. However, architectural requirements require the air pressures to be the same or equalized so as not to reduce the longevity of the wall structure of the building.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels have frame extrusions connected at their edges which are securely held at the fastening extrusions without any screws or other fastening devices.

It is yet another object of the present invention to provide a wall system that is easy to assemble with an existing wall structure.

It is a further object of the present invention to provide a wall system that eliminates the use of plugs to cover the gap between adjacent wall panels.

It is a still further object of the present invention to provide a wall system that provides a cover panel in a gap between adjacent wall panels that is easy to vary in size in accordance with changing dimensions of the gap between the wall panels.

It is a yet further object of the present invention to provide a wall system that permits easy hanging of the wall panels by providing a male connecting wall that merely fits within a female connecting recess of the securing section.

It is another object of the present invention to provide a wall system that facilitates insertion of a male connecting wall within a female connecting recess of the securing section by providing curved surfaces on the free end of the male connecting wall.

It is still another object of the present invention to provide a wall system that provides multiple rows of fastening devices to secure the fastening extrusions to the existing wall structure.

It is yet another object of the present invention to provide a wall system that provides equal air pressure behind and in front of the wall panels.

It is a further object of the present invention to provide a wall system that is easy and economical to manufacture and use.

In accordance with an aspect of the present invention, a system for mounting wall panels to an existing wall structure, includes a plurality of wall panels, each wall panel having a main panel section and hook walls at edges of the main panel section, with the main panel section and each hook wall having a U-shaped cross-sectional profile. There are a plurality of fastening extrusions, each fastening extrusion including a fastening extrusion securing section for securing the fastening extrusion to the existing wall structure, and a fastening extrusion connecting section connected with the fastening extrusion securing section. A frame extrusion is connected to each hook wall. Each frame extrusion includes a frame extrusion securing section for connecting the frame extrusion to a respective hook wall, a frame extrusion connecting section for engagement with one fastening extrusion connecting section, and a spacer wall for connecting the frame extrusion connecting section to the frame extrusion securing section in spaced relation to the hook wall so as to define a gap between the fastening extrusion connecting section and the hook wall when the frame extrusion connecting section is engaged with the one fastening extrusion connecting section. Finally, a cover panel is inserted in the gap.

An arrangement provides that air pressure of ambient atmosphere in front of the wall panels is substantially equal to air pressure behind the wall panels. The arrangement includes at least one of the following:

air spaces in the gap between the cover panel and walls defining the gap, air spaces between the fastening extrusion connecting section and the frame extrusion connecting section, and openings provided in the hook walls.

The fastening extrusion connecting section includes a female connection section with a recess, and the frame extrusion connecting section includes a male connecting wall for engagement within a respective recess of one fastening extrusion connecting section.

The main panel section has a rectangular configuration with four hook walls, and there are four fastening extrusions, with the recess of the female connecting section of each fastening extrusion receiving one male connecting wall of a respective frame extrusion.

Each fastening extrusion includes a supporting section for connecting the female connecting section to the fastening extrusion securing section. The supporting section includes a supporting wall. The female connecting section includes two spaced apart female defining walls extending transversely from the supporting wall and defining the recess between the two spaced apart female defining walls.

In one embodiment, each fastening extrusion includes a second female connecting section connected with the fastening extrusion securing section, the second female connecting section including a second recess, and a male connecting wall of a frame extrusion connected to a different wall panel engages within the second recess of the second female connecting section. The first and second female connecting sections face in opposite directions. Also, the second female connecting section includes two spaced apart female defining walls extending transversely from the supporting section and defining the second recess between the two spaced apart female defining walls. Each fastening extrusion includes a supporting section for connecting the first and second female connecting sections to the fastening extrusion securing section.

In one embodiment, the supporting section includes first and second spaced apart supporting walls, the first supporting wall connecting the first female connecting section to the fastening extrusion securing section, and the second supporting wall connecting the second female connecting section to the fastening extrusion securing section. In such case, the fastening extrusion securing section includes a center section between the first and second supporting walls for securing the fastening extrusion to the existing wall structure, and at least one flange section outside of at least one of the first and second supporting walls for securing the fastening extrusion to the existing wall structure.

In another embodiment, the supporting section includes a single supporting wall, with the first female connecting section connected to one side of the single supporting wall, and the second female connecting section connected to an opposite side of the single supporting wall, such that the first and second female connecting sections face in opposite directions. In such case, the fastening extrusion securing section includes at least one flange section to at least one side of the single supporting wall for securing the fastening extrusion to the existing wall structure.

The male connecting wall includes a curved end to facilitate entry into the recess of the one female connecting section.

The frame extrusion securing section of each frame extrusion includes a U-shaped wall arrangement defining a frame extrusion recess therein for receiving one wall of respective hook wall therein. The spacer wall is connected to a free end of one wall of the U-shaped wall arrangement and extends in a transverse direction to the one wall of the U-shaped wall arrangement, and the frame extrusion connecting section is connected to a free end of the spacer wall and extends substantially parallel and spaced apart from the U-shaped wall arrangement. The U-shaped wall arrangement permits fastening devices to extend transversely through the one wall of the U-shaped wall arrangement and the one wall of the respective hook wall received therein.

The above and other features of the invention will become readily apparent from the following detailed description thereof which is to be read in connection with the accompanying drawings.

DETAILED DESCRIPTION

Figure 1A:
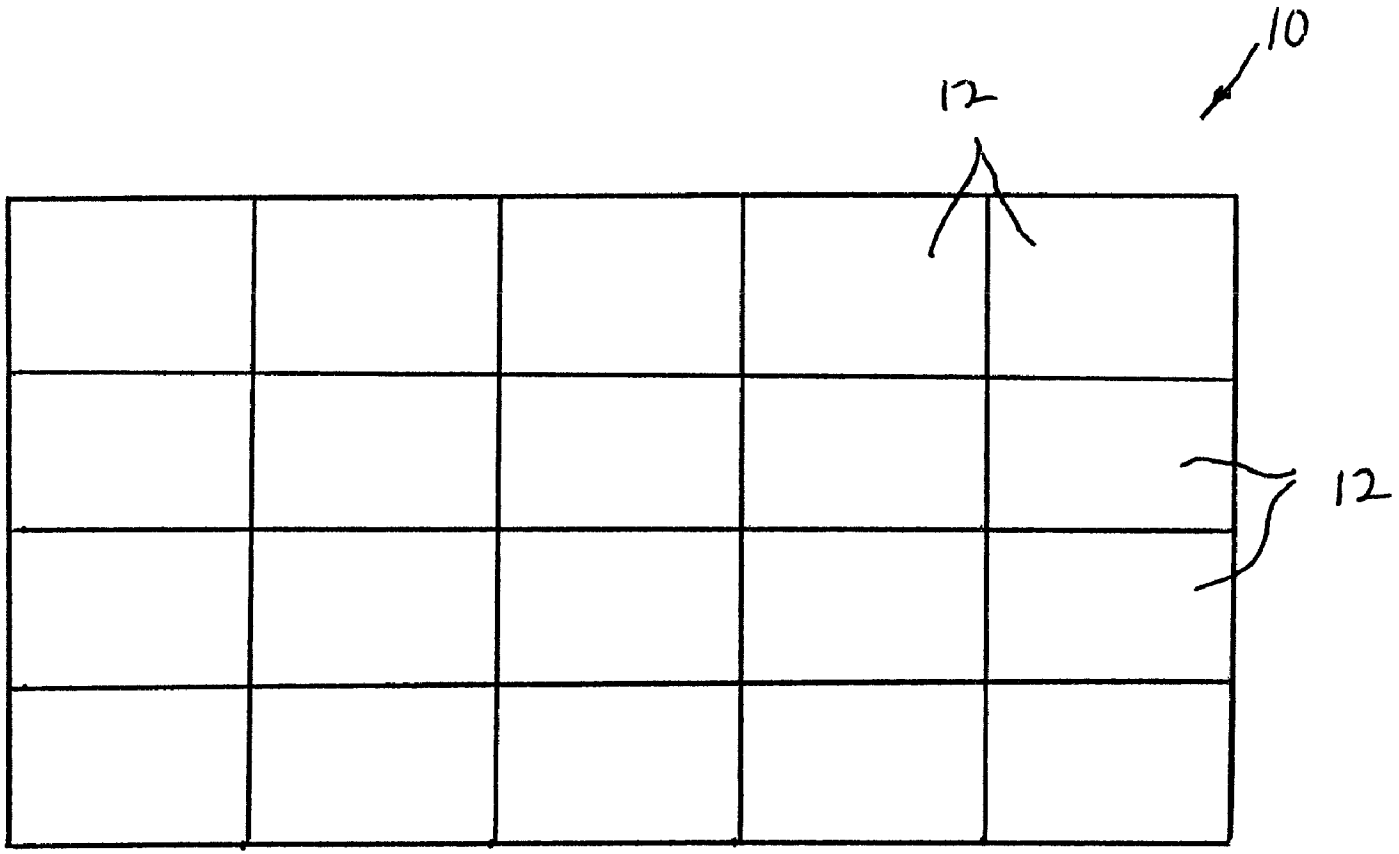
FIG. 1A is an elevational view of a plurality of wall panels mounted to an existing wall structure.
Figure 1:
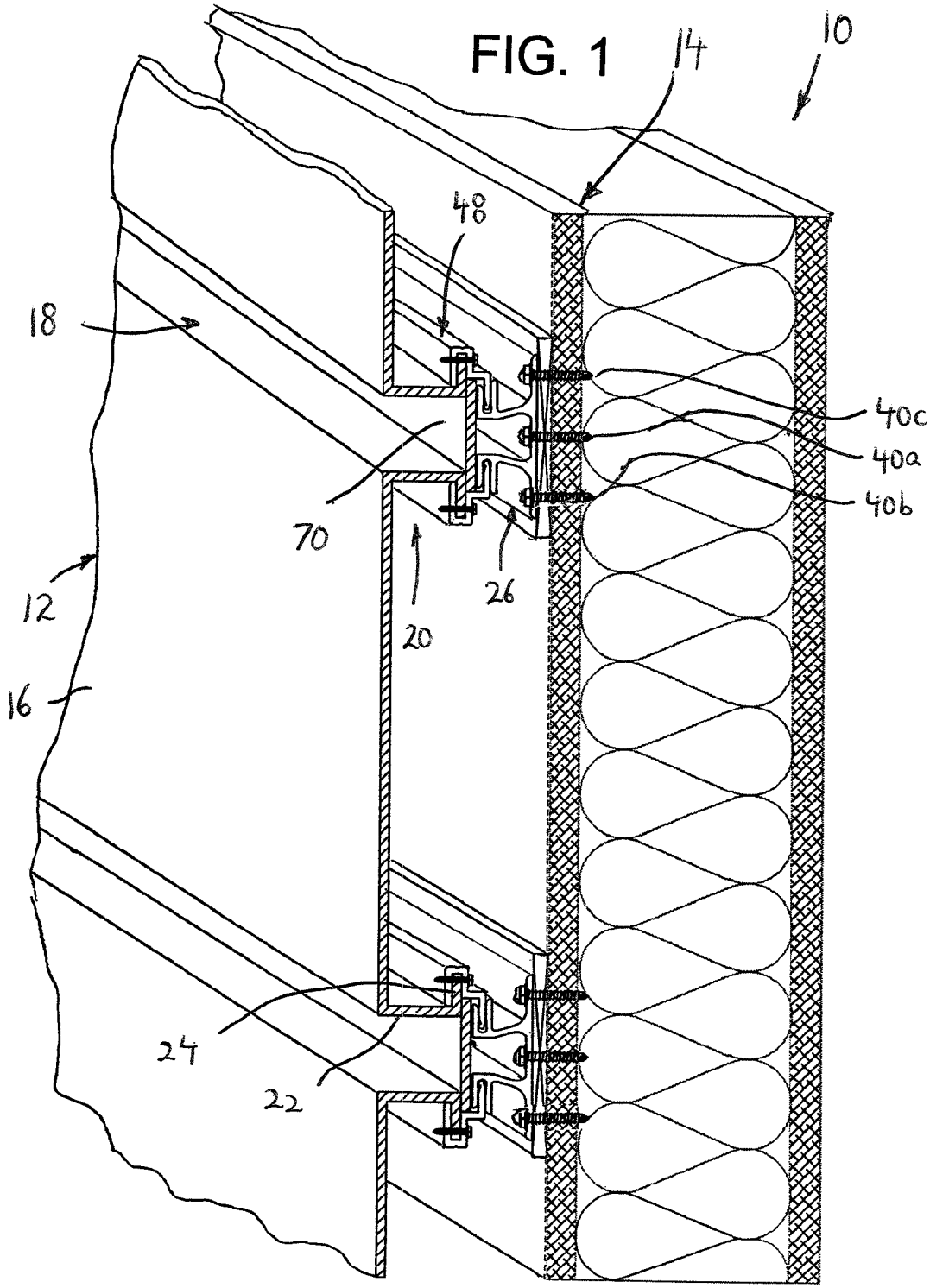
FIG. 1 is a perspective, cross-sectional view of a plurality of wall panels mounted to an existing wall structure according to the present invention.
Figure 2:
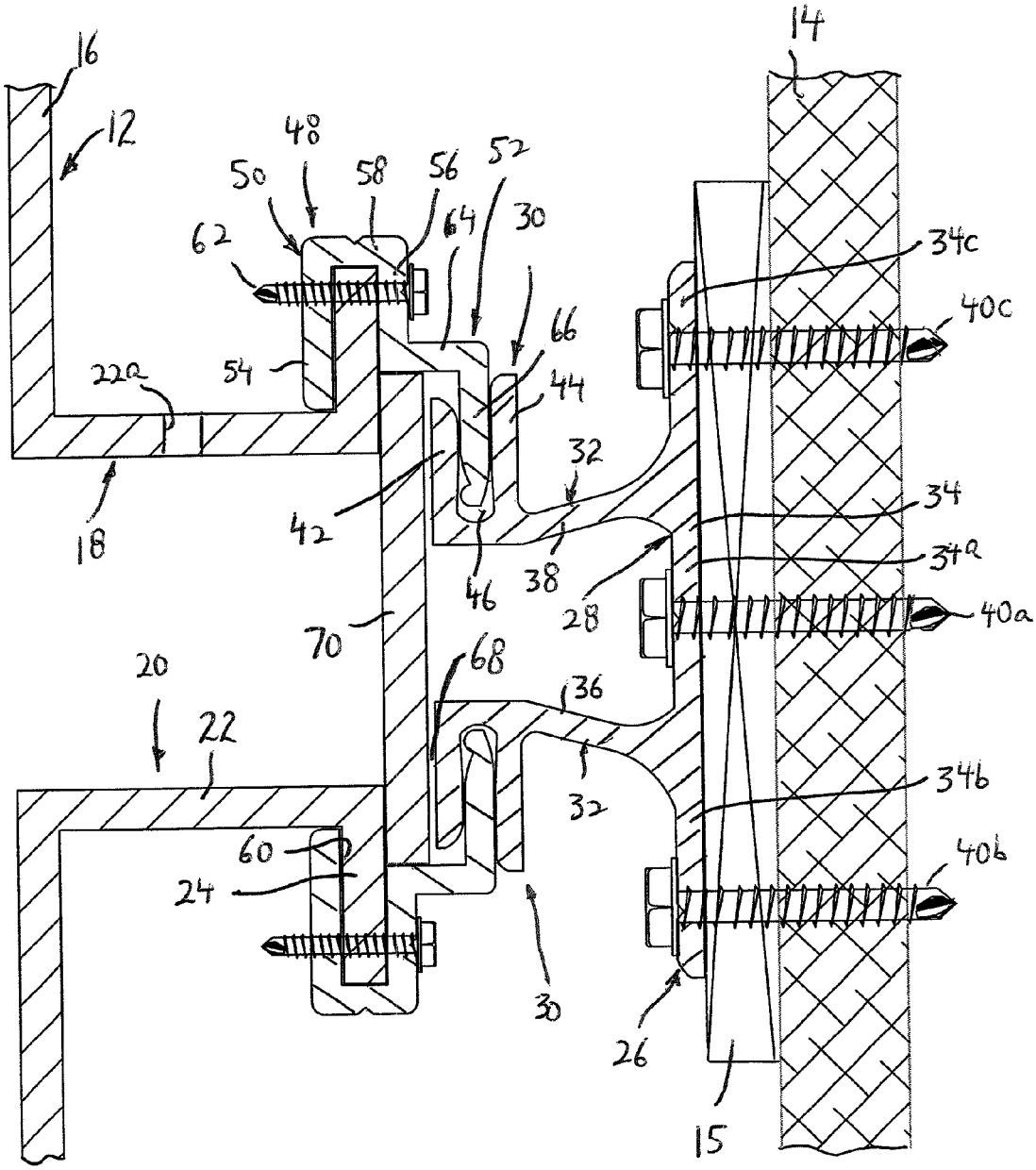
FIG. 2 is an enlarged, cross-sectional view showing two wall panels connected together by an extrusion.

Referring to the drawings in detail, and initially to FIGS. 1-3 and 1A thereof, there is shown a system 10 according to a first embodiment of the present invention for easily mounting wall panels 12 over an existing wall structure 14. Wall structure 14 preferably includes any planar wall. Each panel 12 includes a rectangular shaped, planar main panel section 16 and an L-shaped bend 18 at each edge. As a result, planar panel section 16, together with L-shaped bend 18, forms a U-shaped hook structure 20 at each edge. Specifically, each L-shaped bend 18 includes a first right angle panel section 22 at each free side edge of main panel section 16 which extends at a right angle away from main panel section 16, and a second right angle panel section 24 which extends inwardly at a right angle from the free side edge of first right angle panel section 22 such that each second right angle panel section 24 is positioned behind main panel section 16 in spaced, parallel relation thereto. First right angle panel section 22 may include a plurality of weep holes 22*a* therein, as best shown in FIG. 2, which can be any shape and dimension.

Main fastening extrusions 26 are provided for securing each wall panel 12 to existing wall structure 14. Each main fastening extrusion 26 is preferably formed as a single, one-piece member that includes a base 28 secured to existing wall structure 14, female connecting sections 30 and a supporting section 32 that connects female connecting sections 30 to base 28, such that female connecting sections 30 are provided in substantially parallel, spaced apart relation to base 28.

Base 28 includes a generally elongated planar base wall 34, with supporting section 32 including two spaced apart supporting walls 36, 38 extending substantially perpendicular from the exposed surface of planar base wall 34 in a direction away from existing wall structure 14. As a result, planar base wall 34 is divided into an elongated center section 34*a*, an elongated first flange 34*b* and an elongated second flange 34*c*. Planar base wall 34 is secured to existing wall structure 14 by a plurality of screws 40*a*, 40*b* and 40*c*. Preferably, there are a line of screws 40*a* extending in spaced relation along the length of center section 34*a*, a line of screws 40*b* extending in spaced relation along the length of first flange 34*b* and a line of screws 40*c* extending in spaced relation along the length of second flange 34*c*. Only one screw 40*a*, 40*b* and 40*c* from each row is shown in FIG. 1. A shim 15 may be positioned between base wall 34 and existing wall structure 14.

Each female connecting section 30 includes a first elongated female defining wall 42 extending outwardly and substantially perpendicular from the distal end of a supporting wall 36, 38 in parallel, spaced relation to the respective first or second flange 34*b*, 34*c*, and a second elongated female defining wall 44 extending substantially perpendicular from supporting wall 36, 38 and spaced slightly from female defining wall 42 so as to be in parallel, spaced relation to both female defining wall 42 and the respective first or second flange 34*b*, 34*c*. In this manner, an elongated recess 46 is defined between first and second elongated female defining walls 42 and 44.

To connect wall panels 12 to main fastening extrusions 26, elongated frame extrusions 48 are connected to second right angle panel sections 24. Each frame extrusion 48 includes a U-shaped securing section 50 for securing the frame extrusions 48 to second right angle panel sections 24, and an L-shaped connecting section 52 for securing frame extrusions 48 to female connecting sections 30 of main fastening extrusions 26 without screws.

Specifically, U-shaped securing section 50 includes elongated first and second parallel, spaced apart walls 54, 56 connected together at one end by an elongated connecting wall 58 so as to define a U-shaped cross-sectional configuration, with an elongated recess 60 defined between walls 54, 56 and 58. The spacing between walls 54 and 56 is equal to or slightly greater than the thickness of second right angle panel section 24 so as to receive second right angle panel section 24 within recess 60. In this arrangement, first wall 54 is positioned flush against the inside surface of second right angle panel section 24, while second wall 56 is positioned flush against the outside surface of second right angle panel section 24. A plurality of screws 62 (only one of which is shown) extends transversely through second wall 56, second right angle panel section 24 and first wall 54 to secure U-shaped securing section 50 to second right angle panel section 24.

L-shaped connecting section 52 includes a first elongated spacer wall 64 connected to and extending out in a substantially perpendicular manner from the free end of second wall 56, and a second elongated male connecting wall 66 connected to and extending out in a substantially perpendicular manner from the free end of first elongated spacer wall 64 in a manner so as to be parallel to second wall 56, but spaced therefrom. Second elongated male connecting wall 66 fits within elongated recess 46 to connect wall panels 12 to main fastening extrusions 26 in a hanging manner without screws. The surface 66*b* at the free end 66*a* of second elongated male connecting wall 66 which faces existing wall structure 14 when assembled, is slightly curved away from existing wall structure 14, while the opposite surface 66*c* at the free end 66*a* of second elongated male connecting wall 66 which faces wall panels 12 when assembled, has a convex surface. These curved surfaces 66*b* and 66*c* facilitate the insertion of second elongated male connecting wall 66 into elongated recess 46, thereby aiding in the assembly thereof.

With the above arrangement, because of L-shaped connecting section 52, with second elongated male connecting wall 66 thereof spaced away from second right angle panel section 24 by reason of first elongated spacer wall 64, first elongated female defining wall 42 of female connecting section 30 is spaced away from second right angle panel section 24, providing a gap 68 between second right angle panel section 24 and first elongated female defining wall 42. Accordingly, an elongated planar cover panel 70 is positioned in gap 68 so as to cover and conceal the space between elongated second walls 56 of L-shaped connecting sections 52 associated with adjacent wall panels 12, and provide an aesthetic appearance between wall panels 12. Cover panel 70 preferably has a decorative finish which is the same as, or which complements, the outer exposed surface of main panel section 16.

As a result, the use of channels and plugs according to the prior discussed arrangements is eliminated. This means that, if the distance between wall panels 12, and thereby the distance between elongated second walls 56 of L-shaped connecting sections 52 associated with adjacent wall panels 12, is changed, there is no need to provide a different size channel and plug, but rather, it is merely necessary to cut elongated planar cover panel 70 to the proper size.

Thus, the present invention provides distinct advantages over the prior discussed arrangements.

First, and of great importance, with the prior discussed arrangements, separate channels and plugs are required in order to close off the channels to provide an aesthetic appearance between the wall panels. However, if the gap between adjacent panels is varied, this would also require a plurality of different size plugs, which can further add to the cost of the structure. With the present invention, planar cover panels 70 are provided in the gap 68 between second right angle panel section 24 and first elongated female defining wall 42.

Second, with the present invention, because there is no sealant in the gaps between adjacent wall panels, because there are no air-tight tolerances at the planar cover panels 70 positioned in the gaps 68 and at the male connecting walls 66 in recesses 46, and because of the weep holes 22*a*, there is air flow between the areas behind wall panels 12 and ambient atmosphere in front of wall panels 12. As a result, there is air pressure equalization in front of and behind wall panels 12, which aids in increasing longevity of the wall structure of the building.

Third, unlike the prior discussed arrangements, wall panels 12 merely hang from main fastening extrusions 26 without the need for any fastening devices, such as screws. Specifically, it is only necessary to insert second elongated male connecting walls 66 into recesses 46 of female connecting sections 30 of main fastening extrusions 26. There is thus no need to secure wall panels 12 to main fastening extrusions 26 while supporting wall panels 12, which can be burdensome.

Fourth, by providing second elongated male connecting male connecting walls 66 attached to wall panels 12, it is merely necessary to insert second elongated male connecting walls 66 into recesses 46. This makes it easier to assemble the wall panels, as opposed to the opposite of attempting to align recesses on elongated frame extrusions which fit over planar wall panels of the main fastening extrusions, as in the prior arrangement to Creative Metal Contractors Inc.

Fifth, and associated with the second advantage, the use of the curved surfaces 66*b* and 66*c* enables easier insertion of second elongated male connecting wall 66 into recesses 46.

Sixth, because the Creative Metal Contractors Inc. arrangement provides female connecting sections on the elongated frame extrusions secured to the wall panels, it is not possible to provide fastening screws transversely through the female connecting sections on the elongated frame extrusions and the L-shaped wall of the wall panel. As a result, screws are inserted through the elongated connecting wall of the U-shaped securing section of the fastening extrusions, into the end edges of the second right angle panel sections of the wall panels. Because this connection is not a sufficiently secure connection when the wall panels are hung, the Creative Metal Contractors Inc. arrangement requires additional stabilizing walls that are flush against the inner surfaces of the main panel section and the first right angle panel section of the wall panel, adding extra cost to the assembly. With the present invention, on the other hand, by providing female connecting sections 30 as part of main fastening extrusions 26, and second elongated male connecting walls 66 as part of elongated frame extrusions 48, screws 62 can be inserted transversely across elongated second wall 56, second right angle panel section 24 and elongated first wall 54 to securely hold elongated frame extrusions 48 to wall panels 12, even when wall panels 12 are hung. As a result, there is no need to provide additional stabilizing walls that are flush against the inner surfaces of the main panel section and the first right angle panel section of the wall panel, thereby reducing the cost of the assembly.

Seventh, the present invention provides first and second flanges 34*b* and 34*c* as part of planar base wall 34 of main fastening extrusions 26, through which screws 40*b* and 40*c* can be inserted to better secure main fastening extrusions 26 to the existing wall structure 14. With the prior discussed arrangement of Creative Metal Contractors Inc., there are no such flange sections so that securement of the main fastening extrusions occurs only along a center line, which reduces the secure attachment of the main fastening extrusions to the existing wall structure. Further, because the second elongated male connecting walls of the Creative Metal Contractors Inc. structure is formed on the main fastening extrusions, rather than on the elongated frame extrusions, such second elongated walls would prevent the use of screws 40*b* and 40*c* even if flange sections were be provided.

Figure 4:
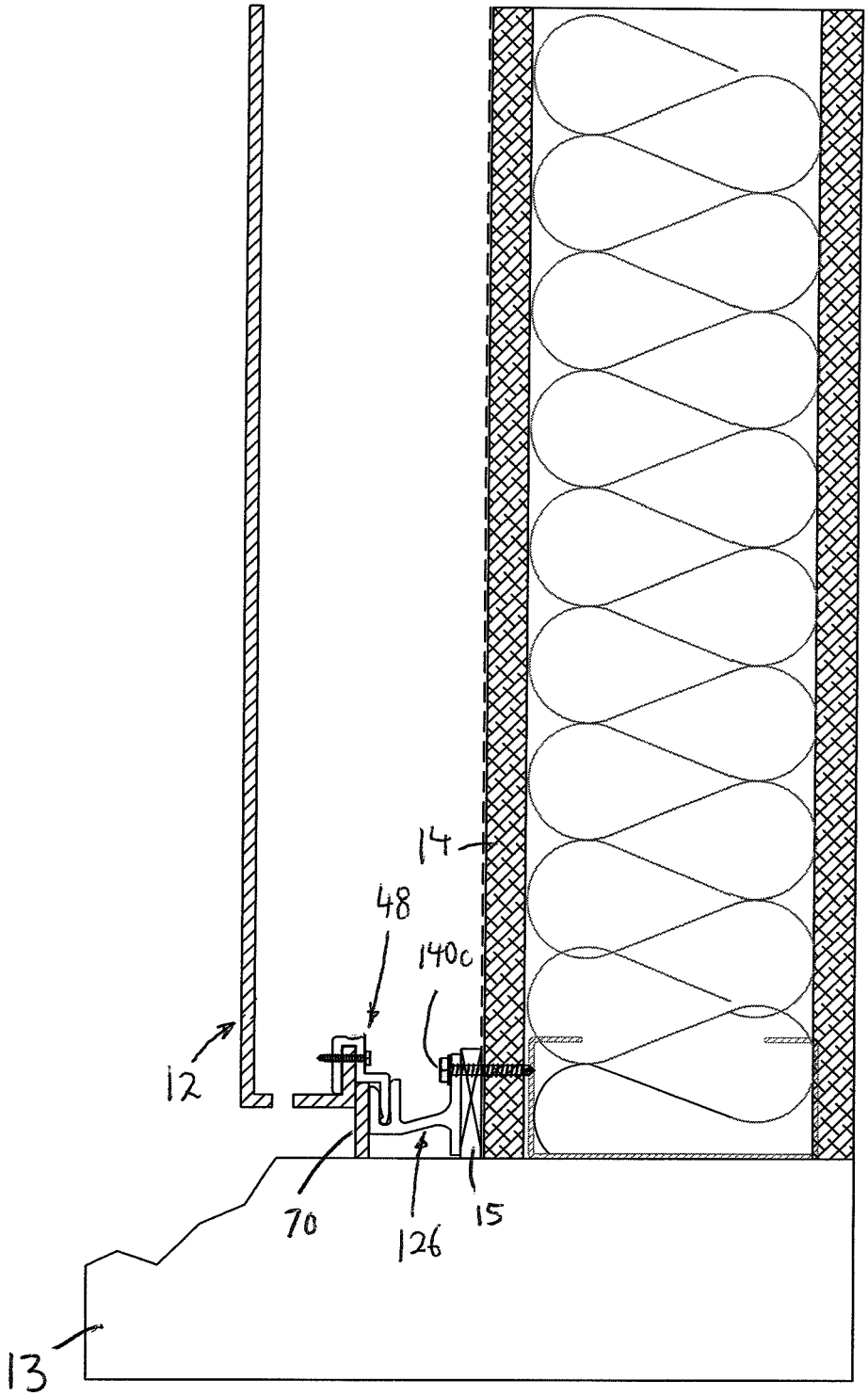
FIG. 4 is a vertical cross-sectional view showing a wall panel secured to an existing wall structure by a starter/end fastening extrusion adjacent a floor.
Figure 5:
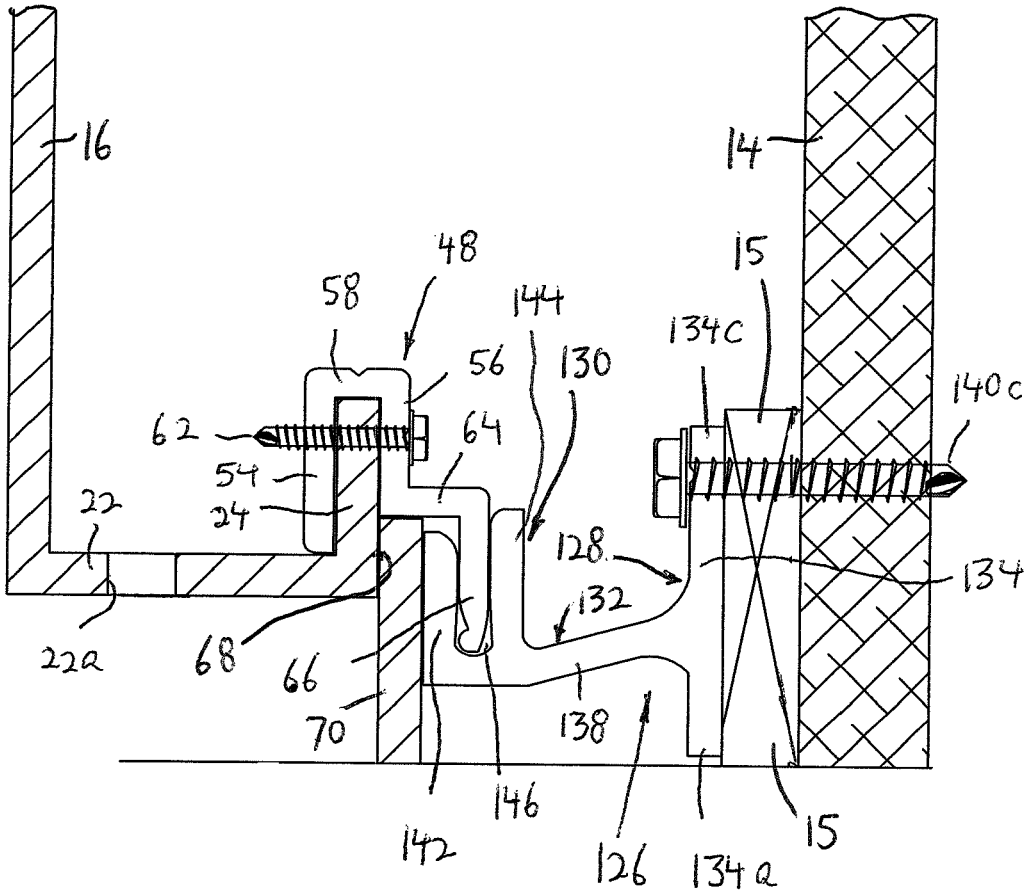
FIG. 5 is an enlarged vertical cross-sectional view of the lower connection portion of FIG. 4.

Referring now to FIGS. 4 and 5, a starter/end fastening extrusion 126 is provided for securing each wall panel 12 to existing wall structure 14. Each starter/end fastening extrusion 126 is effectively formed as one-half of a main fastening extrusion 26. Thus, each starter/end fastening extrusion 126 is preferably formed as a single, one-piece member that includes a base 128 secured to existing wall structure 14, a single female connecting section 130 and a supporting section 132 that connects female connection section 130 to base 128, such that female connecting section 130 is provided in substantially parallel, spaced relation to base 128.

Base 128 includes a generally elongated planar base wall 134, with supporting section 132 including a single supporting wall 138 extending substantially perpendicular from the exposed surface of planar base wall 134 in a direction away from existing wall structure 14. As a result, planar base wall 134 is divided into an elongated center section 134*a* and an elongated flange 134*c*. Planar base wall 134 is secured to existing wall structure 14 by a plurality of screws 140*c*. Preferably, there are a line of screws 140*c* extending in spaced relation along the length of second flange 134*c*. Only one screw 140*c* is shown in FIGS. 4 and 5.

Female connecting section 130 includes a first elongated female defining wall 142 extending outwardly and substantially perpendicular from the distal end of supporting wall 138 in parallel, spaced relation to the respective flange 134*c*, and a second elongated female defining wall 144 extending substantially perpendicular from supporting wall 138 and spaced slightly from female defining wall 142 so as to be in parallel, spaced relation to both female defining wall 142 and flange 134*c*. In this manner, an elongated recess 146 is defined between first and second elongated female defining walls 142 and 144.

The structure of wall panels 12 and fastening extrusions 48 remains the same.

Thus, to start the assembly at the floor 13 of the building, a starter/end fastening extrusion 126 is secured to existing wall structure 14 adjacent floor 13 by a line of screws 140*c* such that the free end of center section 134*a* of base is seated on or near floor 13. Wall panel 12 is then hung on starter/end fastening extrusion 126 by inserting second elongated male connecting wall 66 at the lower wall of the wall panel 12 into recess 146. Thereafter, an elongated planar cover panel 70 is positioned in gap 68 to provide an aesthetic appearance at the floor level and to cover the opening thereat. Elongated planar cover panel 70 can be slid into gap 68 from the side, or alternatively, elongated planar cover panel 70 can be assembled first, prior to inserting second elongated male connecting wall 66 at the lower wall of the wall panel 12 into recess 146.

Figure 3:
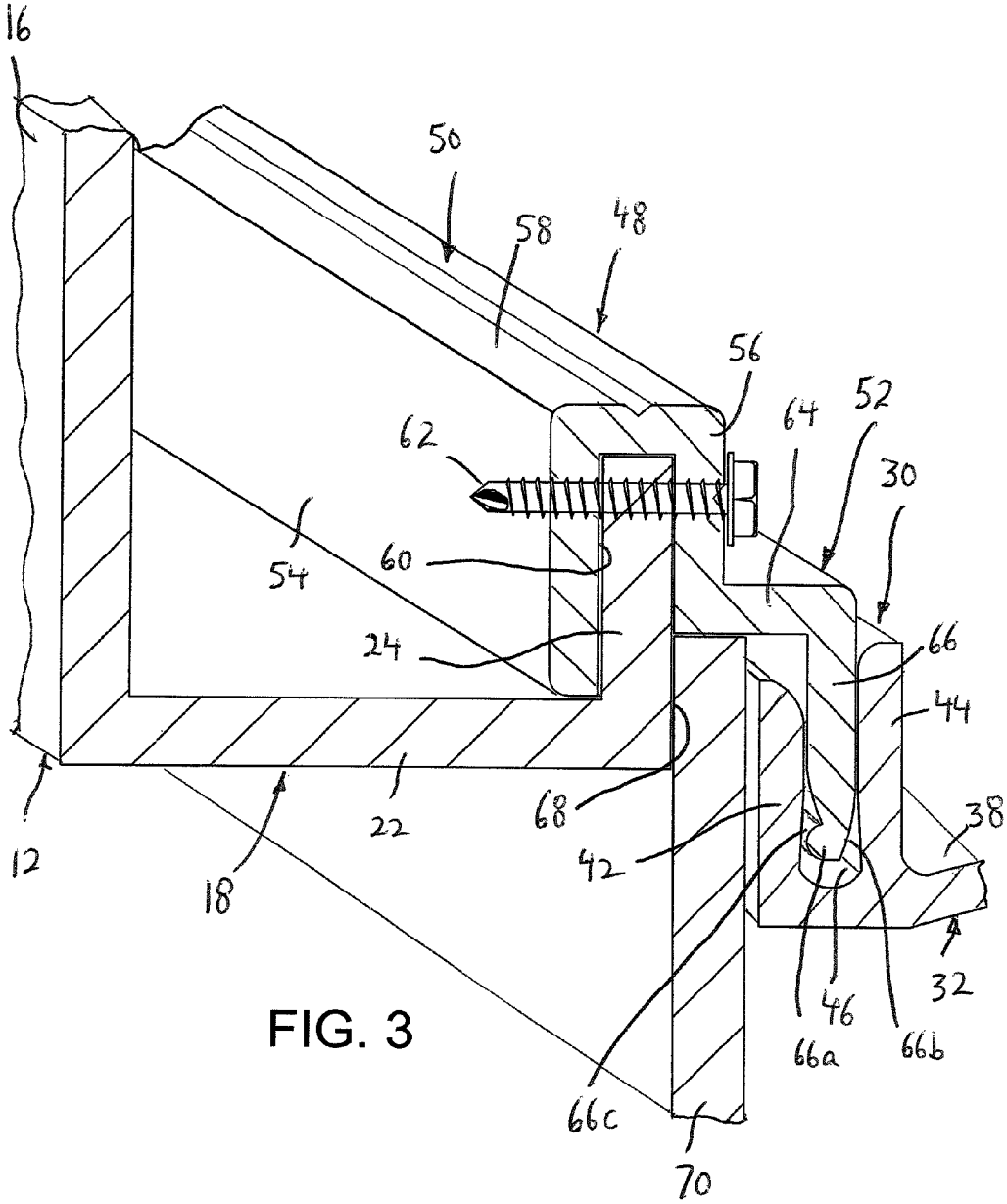
FIG. 3 is an enlarged, perspective, cross-sectional view, showing the hook end of a wall panel connected to an extrusion.

Thereafter, as shown in FIGS. 1-3, a main fastening extrusion 26 is assembled with the upper edge of the wall panel 12 of FIGS. 4 and 5 by positioning the main fastening extrusion 26 (the lowermost one in FIG. 1) behind the upper edge of wall panel 12 and inserting second elongated male connecting wall 66 at the upper wall of the wall panel 12 into recess 46 of this main fastening extrusion 26. This main fastening extrusion 26 is then secured to existing wall structure 14 by screws 40*a* and 40*c*. In this case, it may not be possible to use screws 40*b* which are blocked by the wall panel 12. In this manner, the lowermost wall panel 12 is fully secured to existing wall structure 14.

Then, the next upper wall panel 12 (the middle one shown in FIG. 1) is then hung on this already secured main fastening extrusion 26 by inserting second elongated male connecting wall 66 at the lower wall of the wall panel 12 into recess 46 of the female connecting section 30 connected to supporting wall 38. Thereafter, an elongated planar cover panel 70 is positioned in gap 68 to provide an aesthetic appearance and to cover the opening between the two wall panels 12. Elongated planar cover panel 70 can be slid into gap 68 from the side, or alternatively, elongated planar cover panel 70 can be assembled first, prior to inserting second elongated male connecting wall 66 at the lower wall of the second wall panel 12 into recess 46.

Figure 6:
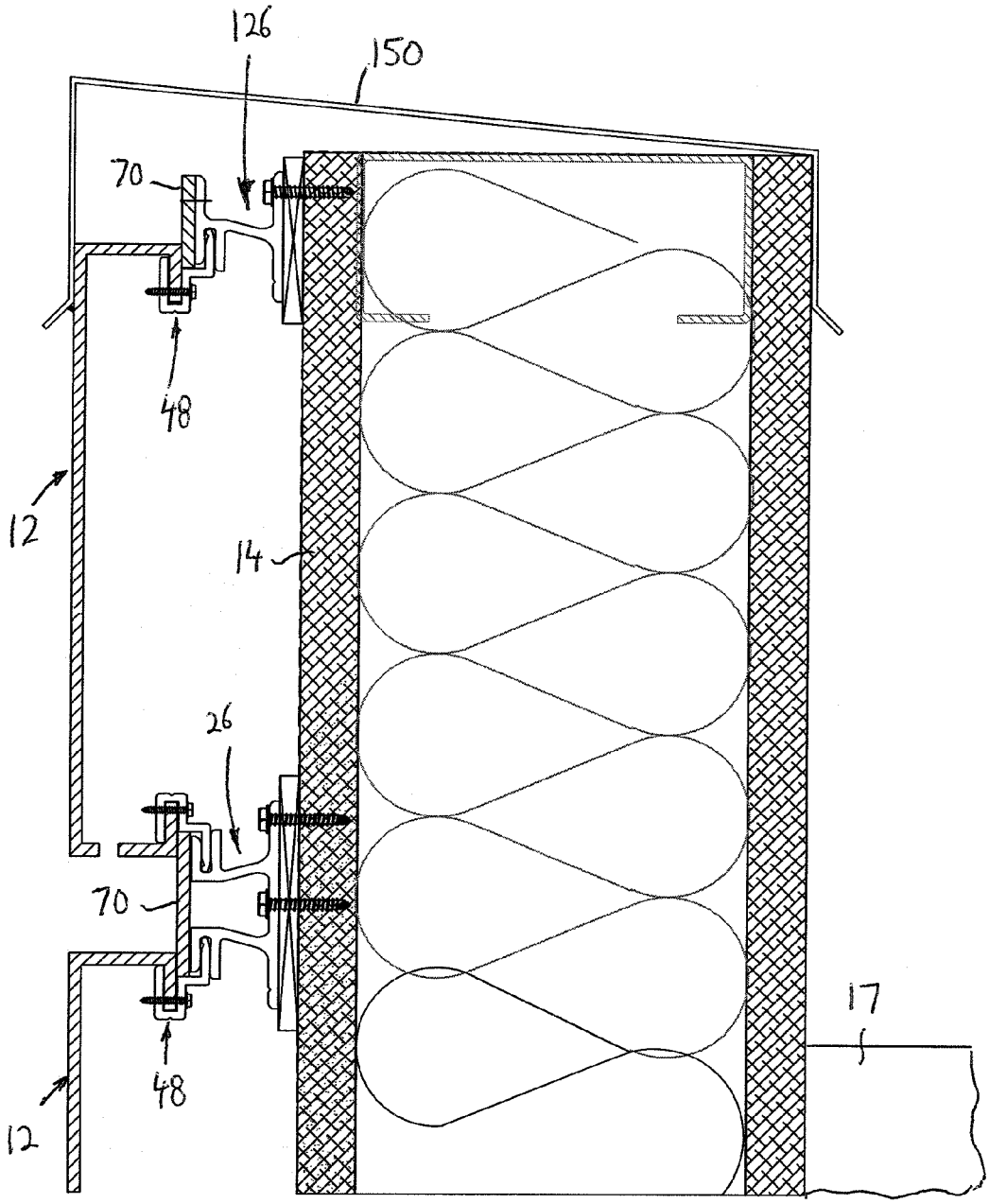
FIG. 6 is a vertical cross-sectional view showing a wall panel secured to an existing wall structure by a starter/end fastening extrusion adjacent a roof.

This process continues vertically up from floor 13 until, as shown in FIG. 6, the uppermost assembled wall panel 12 reaches the upper end of existing wall structure 14 adjacent the roof 17, where a starter/end fastening extrusion 126 is provided to secure the upper end of uppermost assembled wall panel 12 to existing wall structure in the same manner as previously described. A parapet 150 is positioned over the upper forward edge of the uppermost assembled wall panel 12 and existing wall structure 14.

Figure 7:
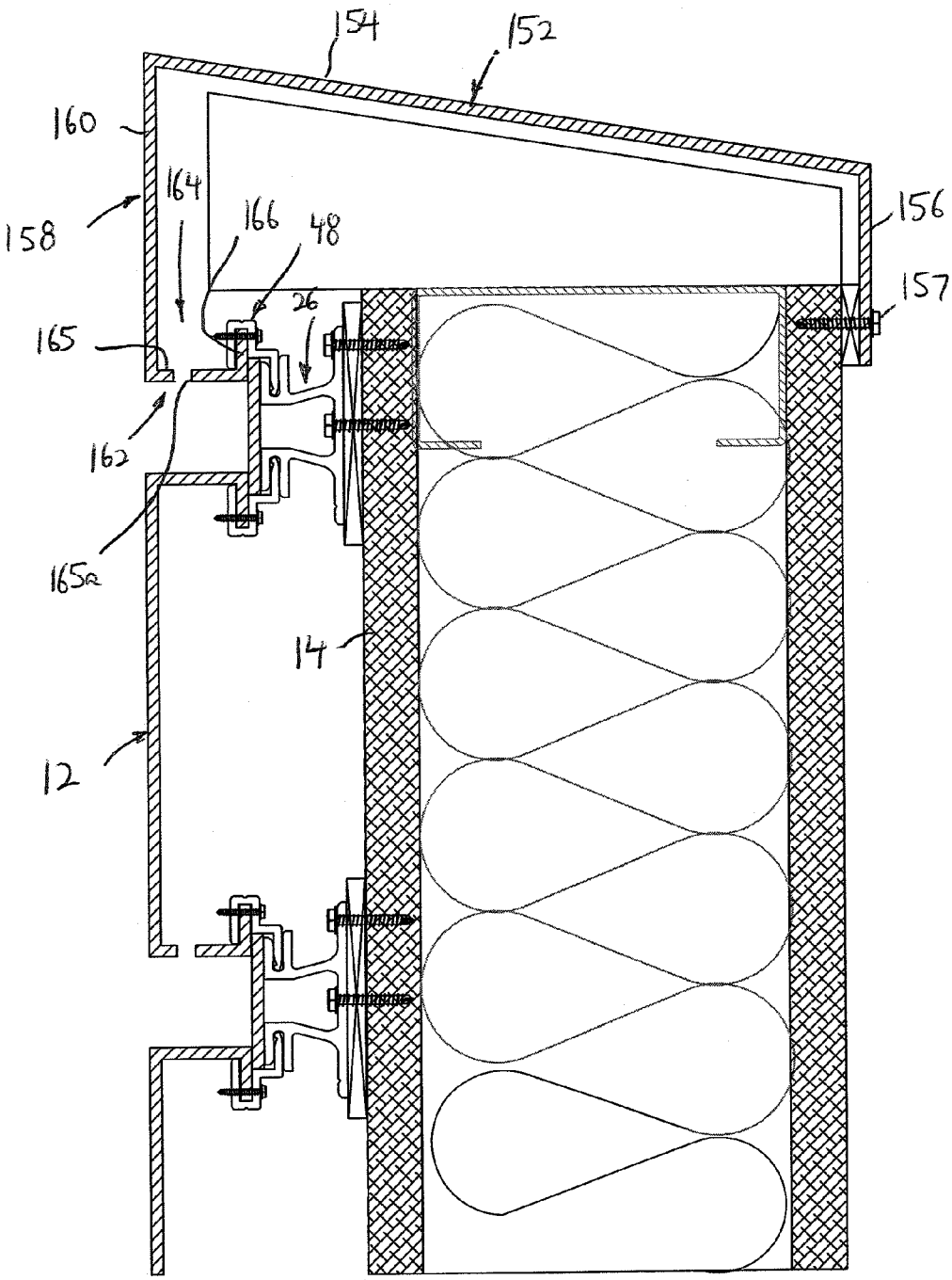
FIG. 7 is a vertical cross-sectional view showing a wall panel secured to an existing wall structure by a starter/end fastening extrusion adjacent a roof according to modification of the present invention.

As an alternative, as shown in FIG. 7, a parapet 152 can be formed with one end similar to that of a wall panel 12. Thus, as shown in FIG. 7, parapet 152 includes an upper slanted panel 154 having a rear securing panel 156 extending down from the rear edge thereof and secured to the rear of existing wall structure 14 by screws 157. A front securing panel 158 extends down from the front edge of slanted panel 154 and is in vertical alignment with wall panels 12. Front securing panel 158 includes a rectangular shaped, planar main panel section 160 which is coplanar with main panel sections 16 of wall panels 12, and an L-shaped bend 162 at the lower edge of main panel section 160. As a result, planar panel section 160, together with L-shaped bend 162, forms a U-shaped hook structure 164 at each edge. Specifically, each L-shaped bend 162 includes a first right angle panel section 165 at each the lower edge of main panel section 160 which extends at a right angle away from main panel section 160 and toward existing wall structure 14, and a second right angle panel section 166 which extends upwardly at a right angle from the free edge of first right angle panel section 165 such that each second right angle panel section 166 is positioned behind main panel section 160 in spaced, parallel relation thereto. First right angle panel section 165 may include a plurality of weep holes 165*a* therein, which can be any shape and dimension.

Thus, U-shaped hook structure 164 is identical to U-shaped hook structures 20, and has elongated frame extrusions 48 secured thereto in the same manner for connection to a main fastening extrusion 26, as shown in FIG. 7.

Thereafter, the process is continued with the next vertical column, and so on, until the entire existing wall structure 14 is covered.

It will be appreciated that, while the present invention has been discussed as starting at floor 13 and working vertically up toward roof 17, it could have easily started at floor 13 and worked horizontally in horizontal rows. After a first row is completed, the next row is started until the panels reach roof 17.

Figure 8:
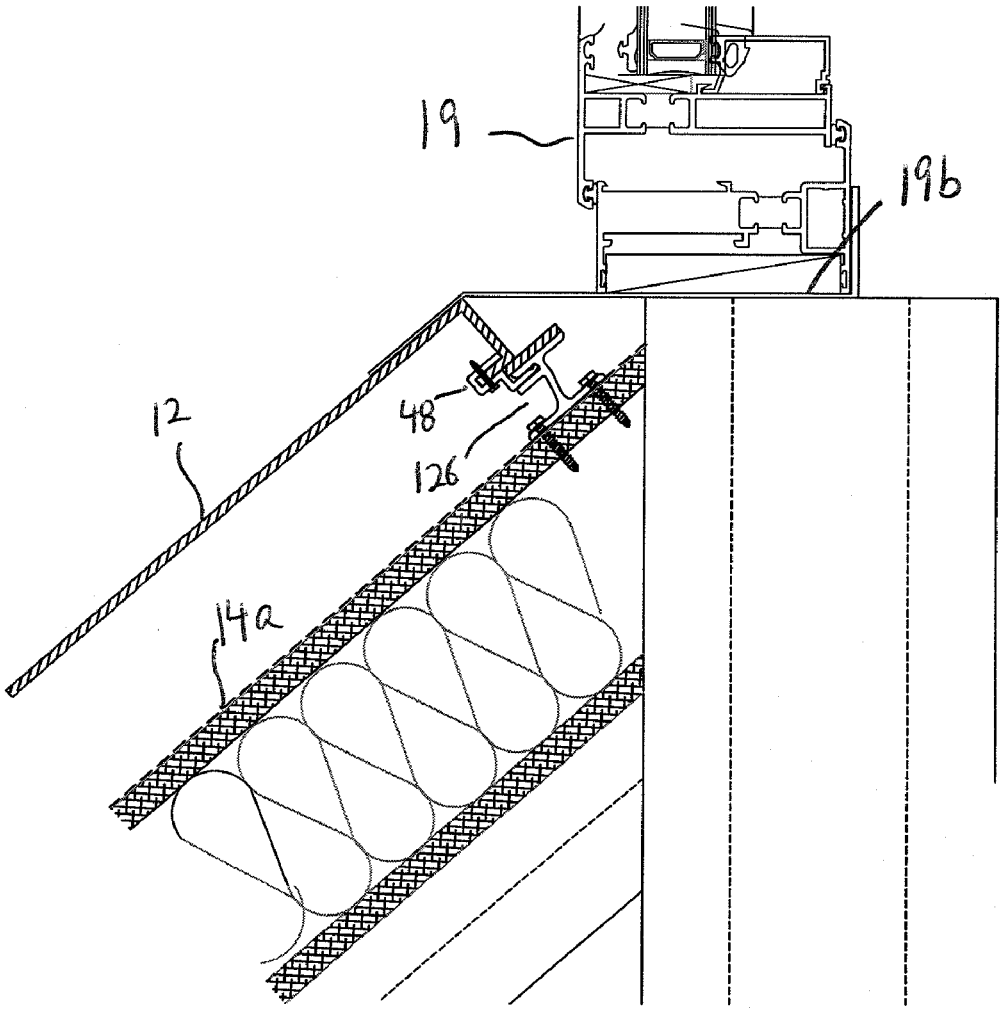
FIG. 8 is a vertical cross-sectional view showing the starter/end fastening extrusion mounting a wall panel on a slanted wall beneath a window sill of a window.
Figure 9:
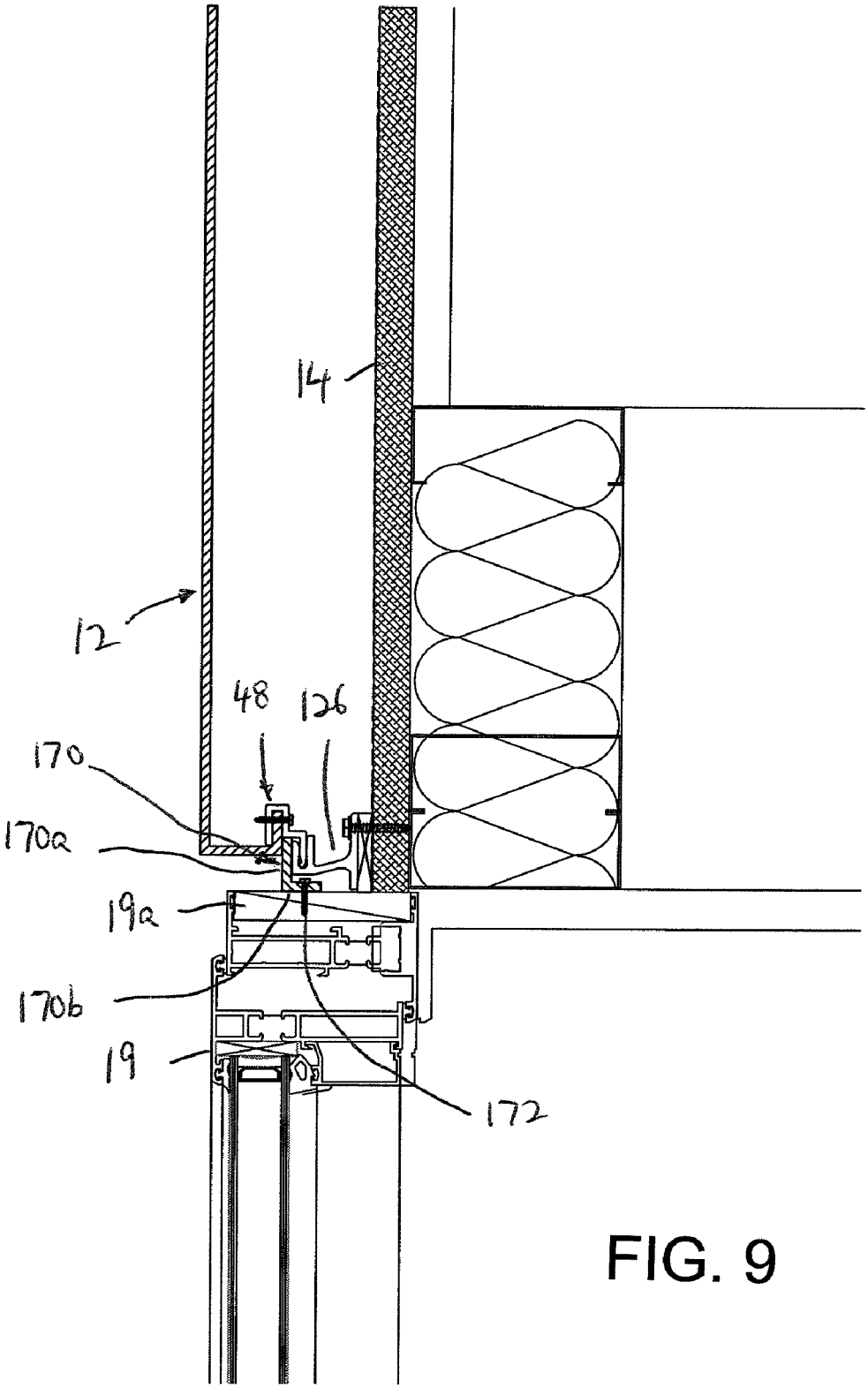
FIG. 9 is a cross-sectional view showing the starter/end fastening extrusion mounting a wall panel adjacent a window.
Figure 10:
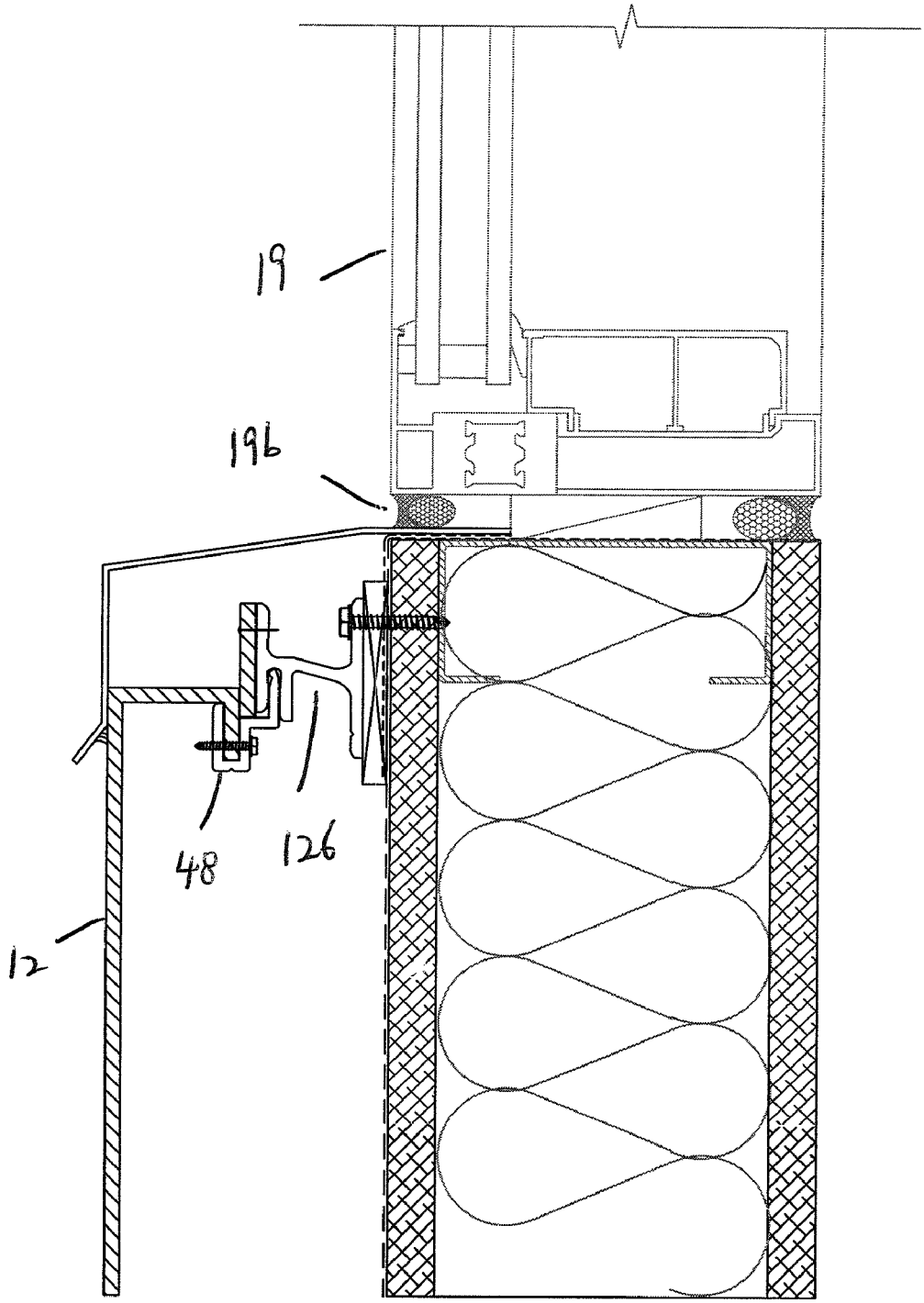
FIG. 10 is a cross-sectional view showing the starter/end fastening extrusion mounting a wall panel below a window sill.

FIG. 8 shows the assembly provided on a slanted wall 14*a* beneath a window sill 19*b* of a window 19, while FIG. 9 shows the assembly provided adjacent a window 19. In the FIG. 9 assembly, a modified L-shaped, elongated planar cover panel 170 is provided, having a main covering panel 170*a* that covers the gap between wall panel 12 and the window 19, and a securing panel 170*b* which is secured to the window jamb 19*a* by screws 172. This planar cover panel 170 can also be used in the embodiment of FIGS. 4 and 5. In this arrangement, securing panel 170*b* is first secured to window jamb 19*a* by screws 172. Then, a starter/end fastening extrusion 126 is assembled with existing wall structure 14, and wall panels 12 are then hung on starter/end fastening extrusion 126 in the manner previously described. FIG. 10 shows the assembly provided with a window sill 19*b* of a window 19.

Figure 11:
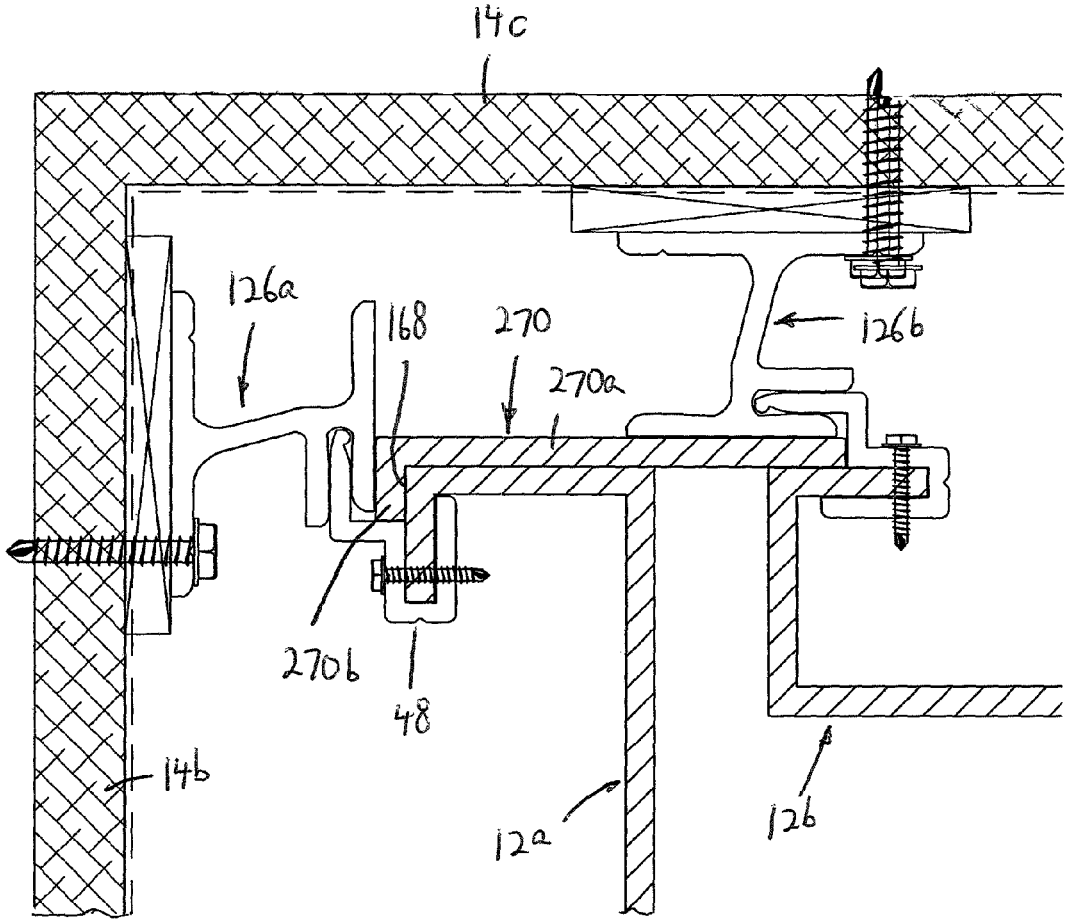
FIG. 11 is a cross-sectional view showing the starter/end fastening extrusions mounting adjacent wall panels at an inside corner of a building.

FIG. 11 shows the assembly mounted at an inside corner of a building. With this arrangement, elongated planar cover panel 270 is formed with a main covering panel 270*a* and a side securing panel 270*b*. To assemble this arrangement, a first wall panel 12*a* is first secured by a first starter/end fastening extrusion 126*a* to one existing wall structure 14*b*. Side securing panel 270*b* is then inserted into gap 168 such that main covering panel 270*a* extends perpendicular to existing wall structure 14*b* and is parallel and spaced from the adjacent perpendicular existing wall structure 14*c*. Then, a second starter/end fastening extrusion 126*b* is secured to the adjacent existing wall structure 14*c* in association with main covering panel 270*a*. The second wall panel 12*b* is then connected with second starter/end fastening extrusion 126*b*.

Figure 12:
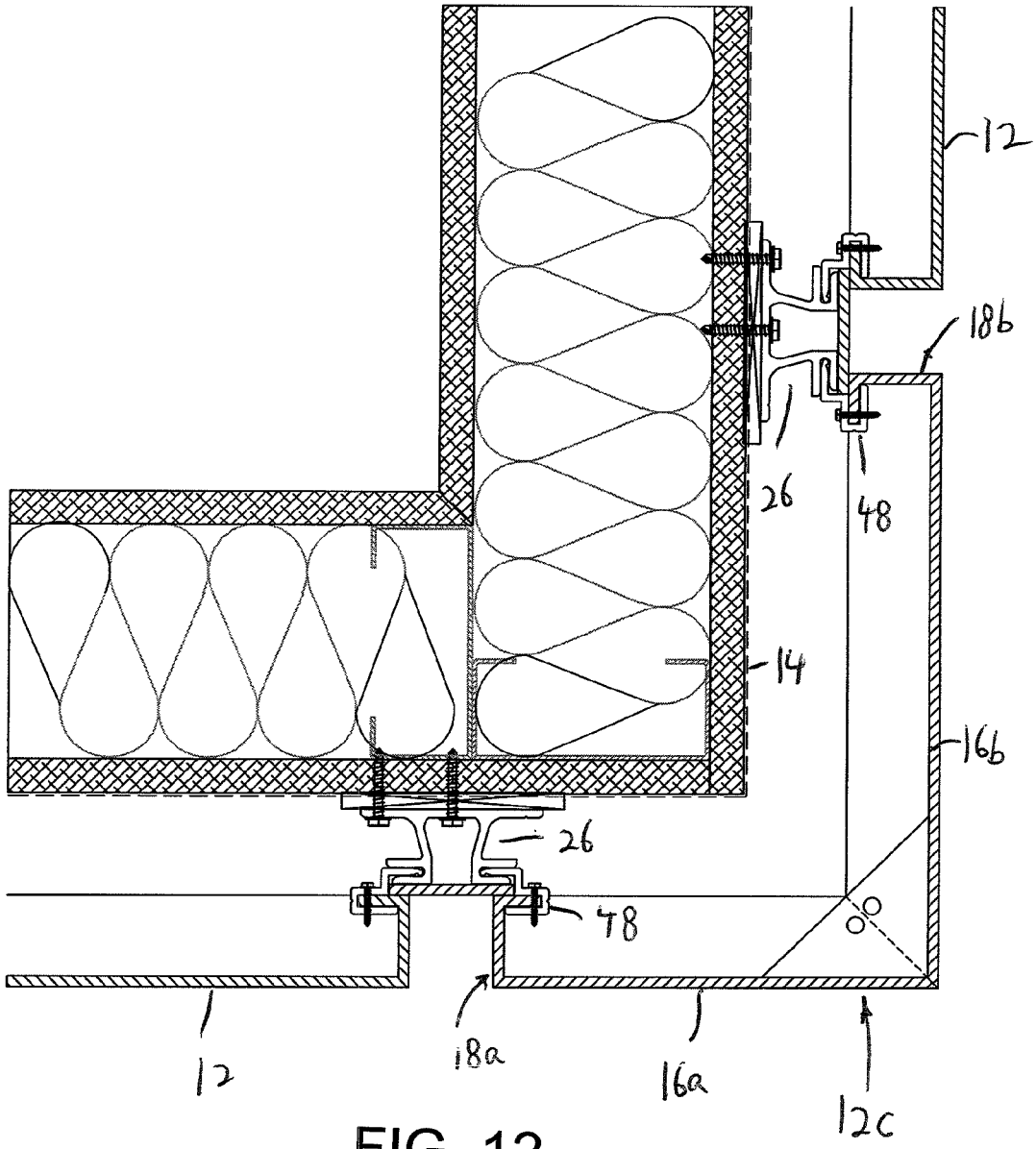
FIG. 12 is a cross-sectional view showing the main fastening extrusions mounting adjacent wall panels at an outside corner of a building.

FIG. 12 shows the assembly mounted to an outside corner of a building. The construction is the same as above, except for a corner wall panel 12*c* having a first main panel section 16*a* and a second perpendicular main panel section 16*b*, each having a free end with an L-shaped bend 18*a*, 18*b*, thereat, with elongated frame extrusions 48 secured thereto and connected with respective main fastening extrusions 26 in the manner discussed above.

Figure 13:
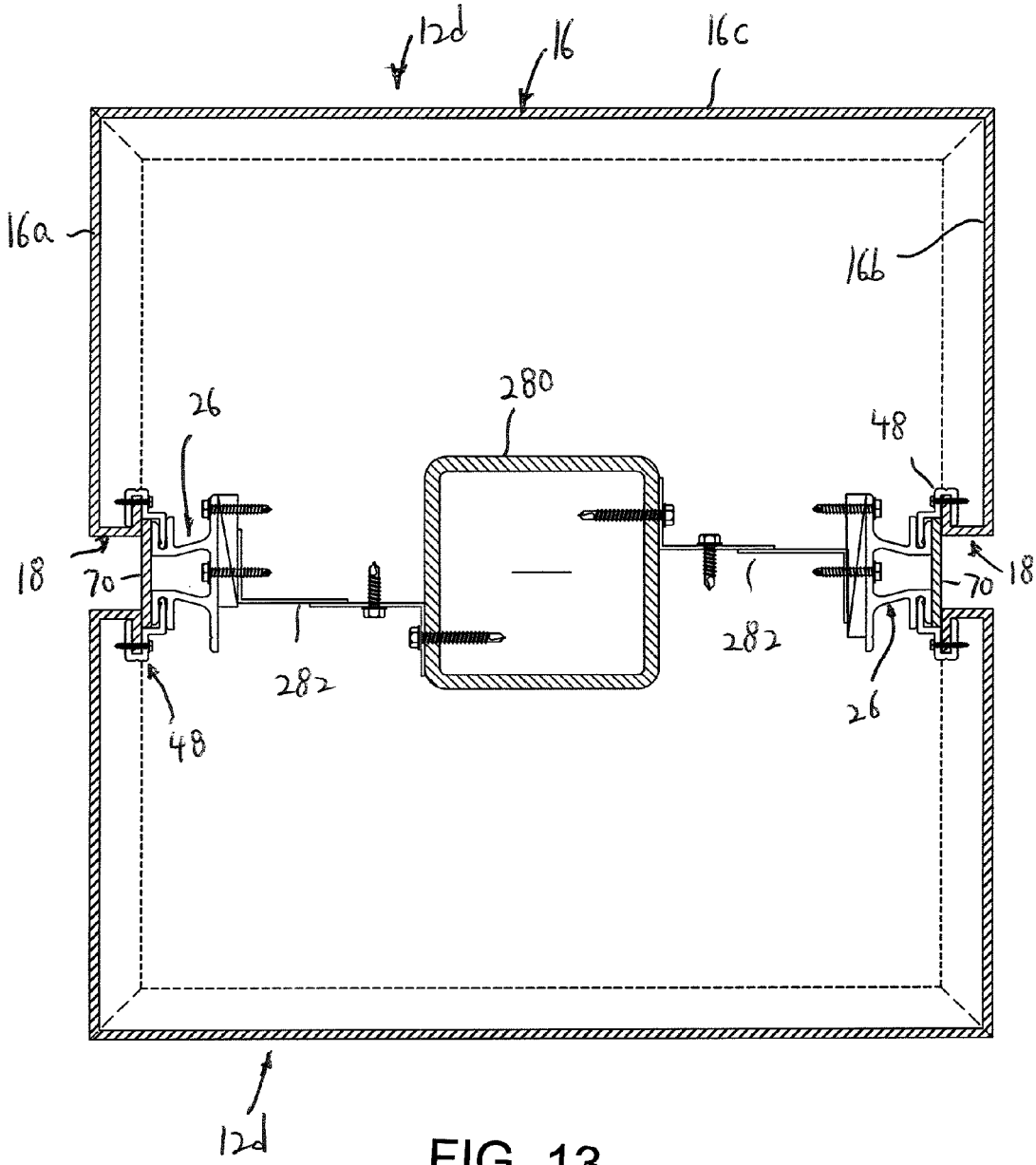
FIG. 13 is a cross-sectional view showing the main fastening extrusions mounting wall panels around a square column.

FIG. 13 shows the assembly mounted to cover a square column 280. With this arrangement, wall panels 12*d* have U-shaped main panel sections 16 which include two parallel, spaced apart walls 16*a*, 16*b* connected by a connecting wall 16*c*, and with L-shaped bends 18 connected to the free ends of walls 16*a*, 16*b*. Extension walls 282 extend from opposite sides of column 280, and main fastening extrusions 26 are secured to free ends of extension walls 282.

As discussed above, the present invention provides versatility in that, if the spacing between wall panels 12 changes, which results from the spacing between supporting walls 36 and 38 changing, planar cover panels 70 are provided in the gap 68 between second right angle panel section 24 and first elongated female defining wall 42. It is merely necessary to cut down the cover panel 70 to the correct size. Thus, there is no need to provide a plurality of different size plugs, which can further add to the cost of the structure.

Figure 14:
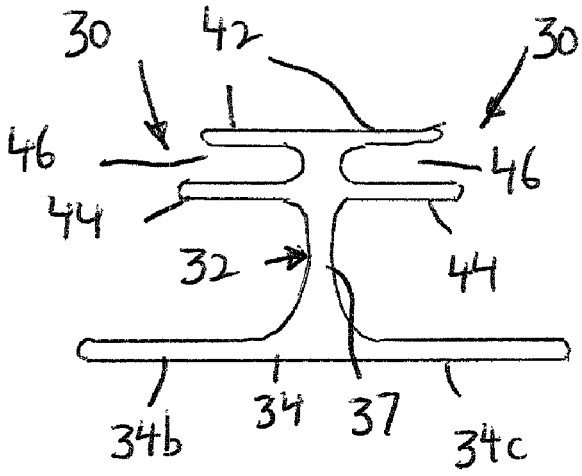
FIG. 14 is a cross-sectional view of a modified main fastening extrusion.

For example, if supporting walls 36 and 38 are merged into a single connecting wall 37, as shown in FIG. 14, the spacing between adjacent wall panels 12 would be very small. As such, center section 34*a* of base wall 34 would be eliminated. In such case, it would only be necessary to cut down the cover panel 70 to the correct size.

Figure 15:
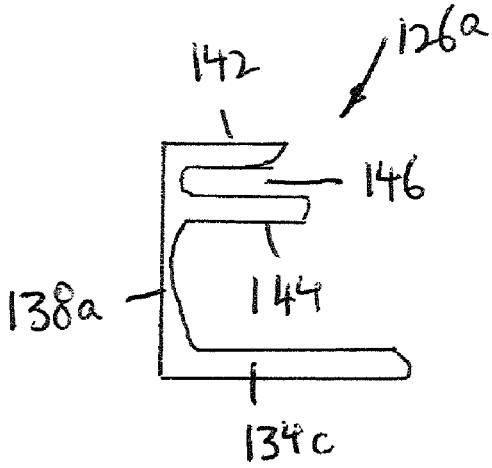
FIG. 15 is a cross-sectional view of a modified starter/end fastening extrusion.

It will be appreciated that various modifications can be made to the present invention within the scope of the claims. For example, FIG. 15 shows a modified starter/end fastening extrusion 126*a* in which supporting wall 138*a* thereof is planar rather than being curved, and in such case, center section 134*a* of base wall 134 is eliminated. The remaining elements of modified starter/end fastening extrusion 126*a* are the same as those in starter/end fastening extrusion 126 and are represented by the same numerals.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel having a main panel section and L-shaped hook walls at edges of the main panel section, with the main panel section and each L-shaped hook wall together defining a U-shaped cross-sectional profile, and with one free wall of each L-shaped hook wall being in parallel spaced relation to the main panel section;

a plurality of fastening extrusions, each fastening extrusion including:

a fastening extrusion securing section for securing the fastening extrusion to the existing wall structure, and a fastening extrusion connecting section connected with the fastening extrusion securing section, said fastening extrusion connecting section includes first and second female connection sections, each with a recess extending in an outwardly facing direction, with the fastening extrusion securing section including at least one flange extending outwardly with respect to said female connection sections to enable at least two lines of securing elements to secure the fastening extrusion securing section to the existing wall structure;

a frame extrusion connected to each hook wall, each frame extrusion including:

a frame extrusion securing section for connecting the frame extrusion in a flush relation to said one free wall of a respective said hook wall, a frame extrusion connecting section for engagement with one said fastening extrusion connecting section, said frame extrusion connecting section including first and second inwardly facing male connecting walls for engagement within said recesses of respective said fastening extrusion connecting section, and a spacer wall for connecting said frame extrusion connecting section to said frame extrusion securing section in spaced relation to said hook wall so as to define a gap between said fastening extrusion connecting section and said hook wall when said frame extrusion connecting section is engaged with said one fastening extrusion connecting section; and a cover panel inserted in said gap.

2. A system according to claim 1, further comprising an arrangement which provides that air pressure of ambient atmosphere in front of said wall panels is substantially equal to air pressure behind said wall panels.

3. A system according to claim 2, wherein said arrangement includes at least one of the following:

air spaces in said gap between said cover panel and walls defining said gap, air spaces between said fastening extrusion connecting section and said frame extrusion connecting section, and openings provided in said hook walls.

4. A system according to claim 1, wherein said main panel section has a rectangular configuration with four said hook walls, and there are four said fastening extrusions, with the recess of the female connecting section of each fastening extrusion receiving one said male connecting wall of a respective said frame extrusion.

5. A system according to claim 1, wherein each fastening extrusion includes a supporting section for connecting said female connecting section to said fastening extrusion securing section.

6. A system according to claim 5, wherein said supporting section includes at least one supporting wall, and each said female connecting section includes two spaced apart female defining walls extending transversely from said at least one supporting wall and defining said recess between said two spaced apart female defining walls.

7. A system according to claim 5, wherein said supporting section includes first and second spaced apart supporting walls, said first supporting wall connecting said first female connecting section to said fastening extrusion securing section, and said second supporting wall connecting said second female connecting section to said fastening extrusion securing section.

8. A system according to claim 7, wherein said fastening extrusion securing section includes:

a center section between said first and second supporting walls for securing said fastening extrusion to the existing wall structure, and said at least one flange section outside of at least one of said first and second supporting walls for securing said fastening extrusion to the existing wall structure.

9. A system according to claim 5, wherein said supporting section includes a single supporting wall, with said first female connecting section connected to one side of said single supporting wall, and said second female connecting section connected to an opposite side of said single supporting wall, such that said first and second female connecting sections face in opposite directions.

10. A system according to claim 9, wherein said fastening extrusion securing section includes said at least one flange section to at least one side of said single supporting wall for securing said fastening extrusion to the existing wall structure.

11. A system according to claim 1, wherein each said male connecting wall includes a curved end to facilitate entry into said recess of said one female connecting section, said curved end having a thickness not greater than a thickness of a remainder of said male connecting wall.

12. A system according to claim 1, wherein the frame extrusion securing section of each frame extrusion includes a U-shaped wall arrangement defining a frame extrusion recess therein extending parallel to said main panel section for receiving one said free wall of a respective said hook wall therein.

13. A system according to claim 12, wherein said spacer wall is connected to a free end of one wall of said U-shaped wall arrangement and extends in a transverse direction to said one wall of said U-shaped wall arrangement, and said frame extrusion connecting section is connected to a free end of said spacer wall and extends substantially parallel and spaced apart from said U-shaped wall arrangement.

14. A system according to claim 12, wherein said U-shaped wall arrangement permits fastening devices to extend transversely through said one wall of said U-shaped wall arrangement and said one wall of the respective said hook wall received therein.

* * * * *